US006832666B2

(12) United States Patent
Stringer

(10) Patent No.: US 6,832,666 B2
(45) Date of Patent: Dec. 21, 2004

(54) MOBILE UTILITY SCAFFOLD HAVING A PLATFORM LOCKING AND SECURING DEVICE

(75) Inventor: Matthew D. Stringer, Archbold, OH (US)

(73) Assignee: bil-jax, inc., Archbold, OH (US)

( * ) Notice: Subject to any disclaimer, the term of this patent is extended or adjusted under 35 U.S.C. 154(b) by 0 days.

(21) Appl. No.: 09/997,359

(22) Filed: Nov. 30, 2001

(65) Prior Publication Data

US 2003/0102186 A1 Jun. 5, 2003

(51) Int. Cl.[7] ..... E04G 1/00
(52) U.S. Cl. ..... 182/118; 182/141
(58) Field of Search ..... 182/141, 118; 292/4, 32, 60, 61, 163, 164

(56) References Cited

U.S. PATENT DOCUMENTS

| | | | | | |
|---|---|---|---|---|---|
| 409,167 | A | | 8/1889 | Brooksmith | |
| 437,054 | A | * | 9/1890 | Smith | 292/4 |
| 1,315,266 | A | * | 9/1919 | Weiland | 292/60 |
| 1,570,135 | A | * | 1/1926 | Emmert | 292/334 |
| 3,298,728 | A | * | 1/1967 | Dye | 292/62 |
| 3,396,817 | A | * | 8/1968 | Perry | 182/187 |
| 3,561,804 | A | * | 2/1971 | Brown | 292/58 |
| 4,263,984 | A | * | 4/1981 | Masuda et al. | 182/113 |
| 4,793,438 | A | | 12/1988 | Perry | |
| 5,028,164 | A | | 7/1991 | Williams | |
| 5,069,309 | A | * | 12/1991 | Swiderski et al. | |
| 5,390,761 | A | * | 2/1995 | Perry | 182/118 |
| 5,931,260 | A | | 8/1999 | Beauchamp | |
| 6,202,788 | B1 | | 3/2001 | Busch et al. | |
| 6,273,381 | B1 | | 8/2001 | Riblet | |
| 2002/0096397 | A1 | * | 7/2002 | Wyse | 182/118 |

* cited by examiner

*Primary Examiner*—Alvin Chin-Shue
(74) *Attorney, Agent, or Firm*—Emch, Schaffer, Schaub & Porcello Co., L.P.A.

(57) ABSTRACT

Scaffold having a locking and securing device for securing a first support to a second support is disclosed where the locking and securing device is movable between a secured position and an unsecured position by using a force at a substantially center point of the securing means.

20 Claims, 6 Drawing Sheets

MOBILE UTILITY SCAFFOLD HAVING A PLATFORM LOCKING AND SECURING DEVICE

FIELD OF THE INVENTION

The present invention relates to a mobile utility scaffold having a locking and securing device for attaching a scaffolding platform side rail to a supporting structure.

BACKGROUND OF THE INVENTION

Scaffolds are used in many situations to provide an elevated platform for workers. Most scaffolding is made of tubular metal which is welded together to have vertical legs with horizontal rungs extending between the legs to form a ladder-like vertically extending supporting structure. Horizontally positioned platforms are held on side rails which are mounted to the vertically extending support structures.

Since scaffolding is often moved between work stations or is added to as work is completed, it is desired to design and construct scaffolding that is easy to assemble and disassemble and which also is very secure. It is also desired to have scaffolding which is economical to manufacture and is easily collapsed, stored and moved from one work location to another. In the industry, in order to make the scaffolding easy to assemble and adjust, the vertical and horizontal structures are made with tolerances such that the horizontal and vertical structures can be easily placed adjacent another. Since the vertical and horizontal supporting structures are manufactured with dimensions that allow one structure to be moved relative to the other structure, sometimes the resulting scaffold structure can be unreliable, shaky or difficult to secure. One problem is that these assembled scaffolding structures need to have secure locking mechanisms so that the horizontal structures and the vertical structures do not move relative to each other during use.

One type of latch mechanism M currently used by the owners of the instant invention is shown in FIG. 6. An L-shaped pin P is held by a bracket welded to a horizontal support H. The L-shaped pin P extends through a spring S and the pin extends through an opening O in a vertical support V. The L-shaped pin P has a roll pin R adjacent the end of the pin P. To operate, a force is placed on the depending arm of the L-shaped pin P to either push or pull the pin P into or out of the opening O in the vertical support V.

Another type of prior art latch mechanism is shown in FIG. 7. A G-shaped pin G is held by a bracket B' welded to a horizontal support H'. The G-shaped pin G extends through a spring S' and extends through an opening O' in a vertical support V. The G-shaped pin G has a roll pin R' which extends in a vertical direction through one end of the pin G. To operate, a force is placed on the depending curved arm of the G-shaped pin G to either push or pull the pin G into or out of the opening O' in the vertical support V'.

Many other types of latch mechanisms have been used to secure the horizontal platform to the vertical supporting structure. Examples of several of these efforts are shown in U.S. Pat. Nos. 409,167; 4,793,438; 5,028,164; 5,390,761; 5,931,260; 6,202,788 B1 and 6,273,831 B1.

One problem with the current latch mechanisms for scaffolding is that the latch mechanism could become loose or disengaged during use. Often a worker, while standing on the platform, moves about the platform which causes shifting and constant realignment of the horizontal work surface with respect to the vertical supporting structures. This lateral movement of the horizontal work surface could tend to cause the latch mechanisms to become loose or displaced relative to their initial position.

Latch mechanisms that use springs to hold the latch mechanism in position often present further problems. The use of springs has made the latch mechanism more difficult to operate. Typically, a great amount of force is needed in order to overcome the bias of the spring in order to disengage the latch mechanism. Often, the horizontal and/or vertical structure must be secured or stabilized with one hand while the other hand of the worker disengages the latch mechanism. In such situations, the scaffolding must be adjusted at least four individual spots and often times the one side of the horizontal structures are positioned at an acute angle with respect to the vertical structure during this adjustment period, causing undesirable stresses on the still-locked opposing latch mechanism.

Still other problems with the currently used latches occur since the scaffoldings are often used in construction and other work environments where material such as work equipment, debris or supplies are constantly being moved onto and off of the scaffolding. It is important to have a latch mechanism which cannot be accidentally disengaged and further which does not interfere with the movement of the worker, worker's tools or supplies, or any debris or materials being moved by the worker.

It is therefore an object of the present invention to provide a locking and securing mechanism that is easily secured and, further, is held in a secured locking position.

It is a further object of the present invention to provide a locking and securing mechanism which positively indicates that the mechanism is in a properly secured and locked position.

It is a further object of the present invention to provide a locking and securing mechanism which is inexpensive to manufacture.

It is yet another object of the present invention to provide a locking and securing mechanism which is strong and resistant to breakage or shearing.

It is yet another object of the present invention to provide a locking and securing mechanism which is easy to use and operate with one hand, such that two opposing locking and securing mechanisms can be simultaneously operated by one worker.

It is another object of the present invention to provide a scaffolding which is easy to be assembled and disassembled while also providing a strong and secure work surface for a worker.

It is another object of the present invention to provide a scaffolding in which a horizontal work platform can be quickly moved to new positions relative to vertical support structures.

Still another object of the present invention is to provide a locking and securing mechanism for a scaffolding which securely connects a horizontal work platform to vertical supporting structures of the scaffolding.

It is still a further object of the present invention to provide a locking and securing mechanism that can be used with currently available horizontal support structures and vertical support structures of a scaffolding system.

Yet another object of the present invention is to provide a scaffold assembly in which the platform securely held in horizontal position without moving out of place or becoming disengaged during use of the platform.

Additional objects, features and advantages of the present invention will become apparent to those skilled in the art upon consideration of the following detailed description of a preferred embodiment as described herein.

SUMMARY OF THE INVENTION

A device for locking and securing a first support to a second support is described. The locking and securing device includes a means for securing the first support to the second support. The securing means is moveably attached to the first support such that the securing means is moveable between a secured position and an unsecured position with respect to the second support. A force is applied at a substantially a center point of the securing means in order to move the securing means. The securing means has a handle positioned at a substantially center point of a securing pin for receiving the applied force.

The locking and securing device further includes a means for locking the first support to the second support. In one embodiment, the locking means is integrally formed with the securing means. During operation of the locking and securing device, the securing means is rotatably moveable about a longitudinally axis extending through the securing means. The securing means is also longitudinally moveable along the longitudinal axis such that the securing means is moved between the secured and unsecured positions and the locking means is moved between the locked position and the unlocked position.

In one aspect, the locking and securing device comprises an engagement member and a securing mechanism. The securing mechanism includes a longitudinally extending securing pin and a handle positioned in a substantially centered relationship with respect to the securing pin. The securing mechanism further includes a locking member positioned on the handle in a spaced apart relationship to the securing pin.

The securing pin extends through an opening in the engagement member such that the locking member is engageable with the engagement member when the locking member is in a locked position.

In one embodiment, the securing pin defines a radially extending opening at a midpoint of the securing pin for receiving a rivet pin. A first biasing means is axially positioned on the securing pin between the rivet pin and a first end of the securing pin. A second biasing means is axially positioned on the securing pin between the rivet pin and a second end of the securing pin.

In another embodiment, the scaffolding system comprises at least one horizontal support and at least one vertical support and a locking and securing device lock for securing and locking the horizontal support to the vertical support.

DESCRIPTION OF THE PREFERRED EMBODIMENT

Figure 1:
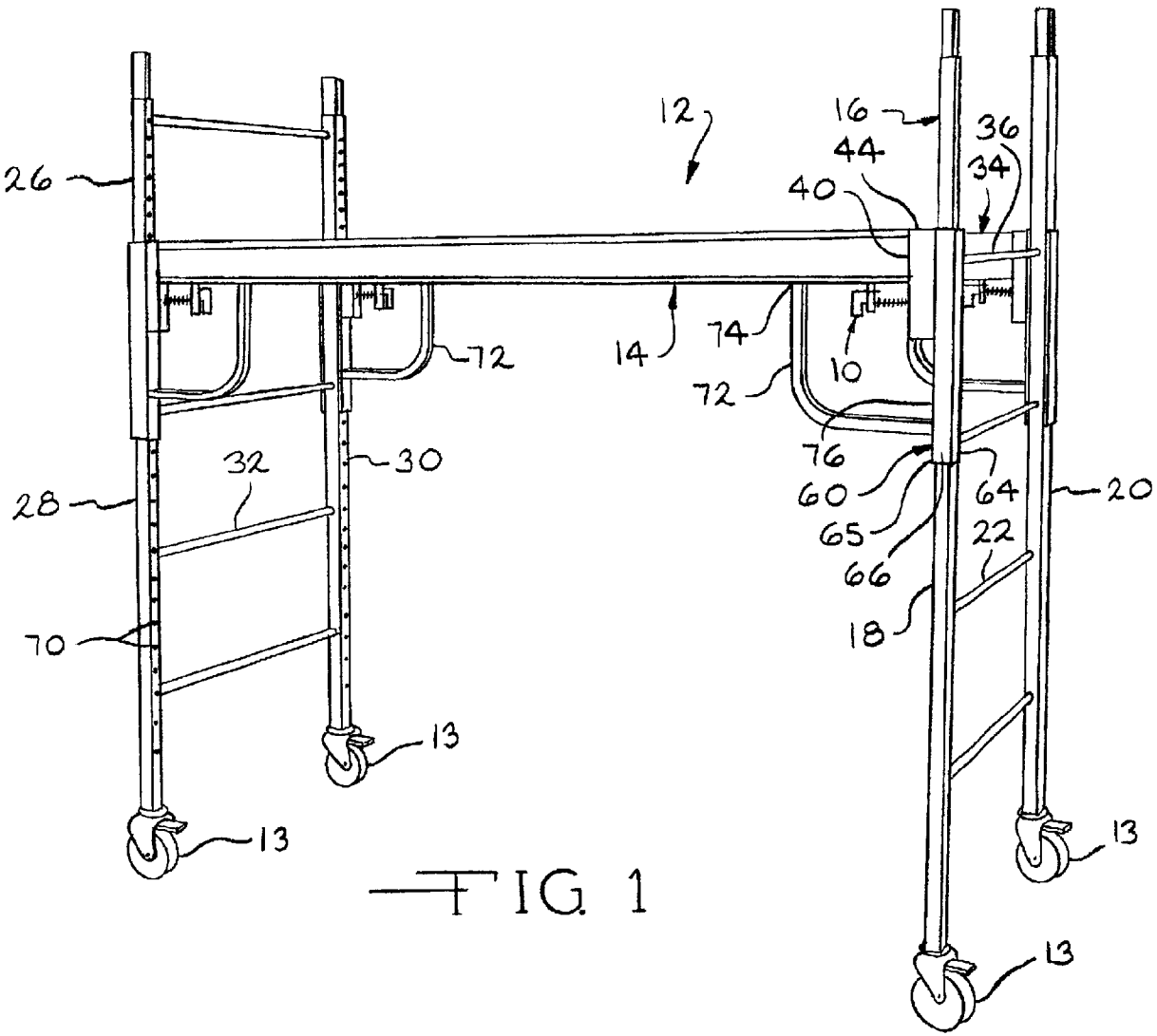
FIG. 1 is a perspective view of a scaffolding incorporating a locking and securing device for securing a horizontally positioned side rail to a vertically extending support structure.

Referring to FIG. 1, a locking and securing device 10 is shown as a component of a scaffold 12 operatively mounted on individual wheels 13. The scaffold system 12 includes a horizontal side rail 14 structure operatively connected to a vertical supporting structure 16. In the embodiment shown, the vertical supporting structure 16 comprises a first, or front, vertical support member or leg 18, operatively connected to a second, or rear, vertical support member or leg 20 and having positioned therebetween a plurality of horizontally extending rungs or horizontal supports 22. It is to be understood that the scaffolding typically comprises an opposing vertical support structure 26 which is similar to the first vertical support structure 16, and has a first leg 28, a second leg 30 and rungs 32 positioned horizontally therebetween.

The scaffold 12 further comprises a second horizontal side rail structure 34 which is in opposed and parallel relationship to the first side rail structure 14. A work platform 36 is horizontally positioned between, and is held in position by, the first side rail 14 and the second side rail 34.

Figure 2:
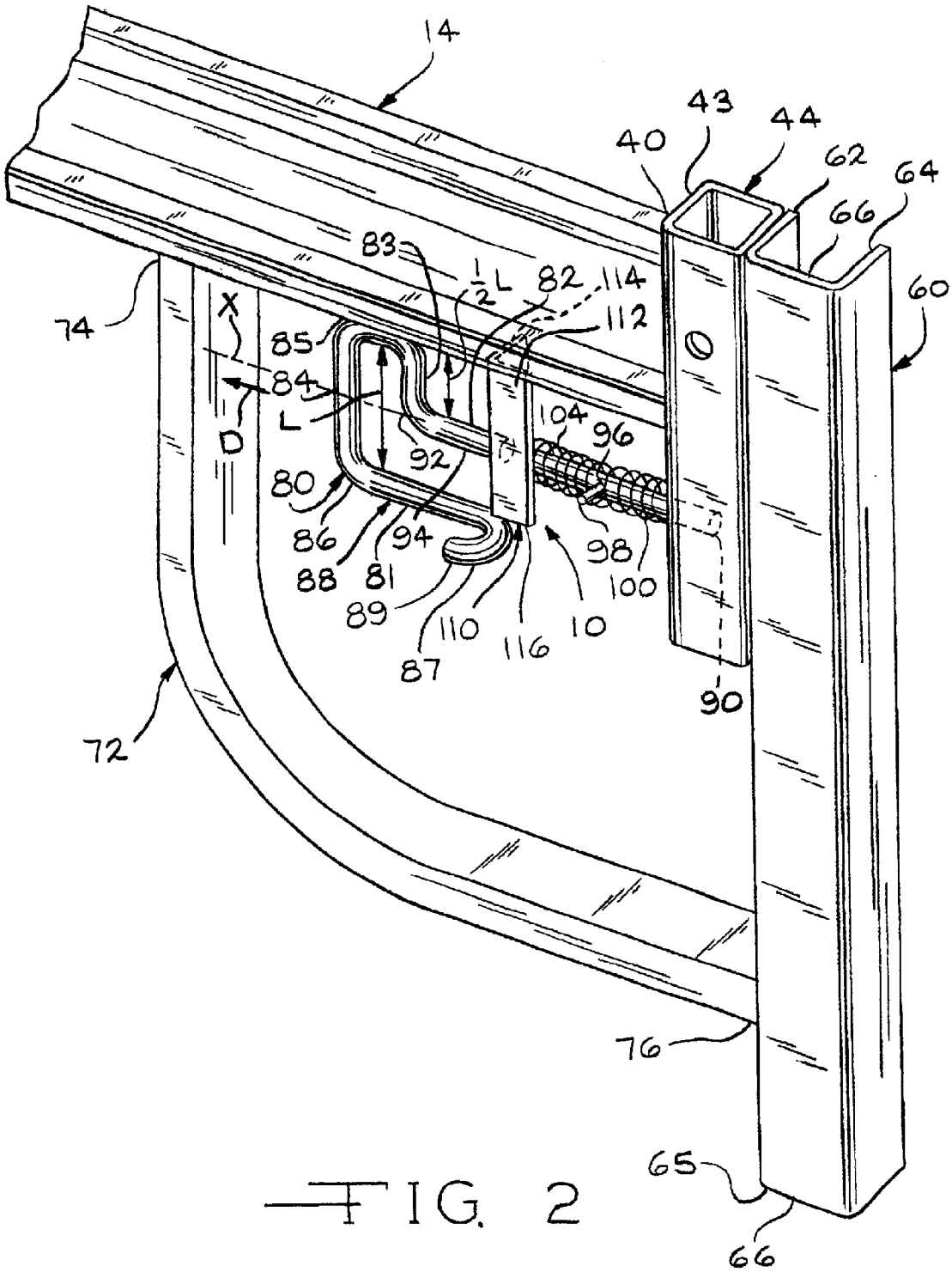
FIG. 2 is a perspective view, partially in phantom, of a locking and securing device incorporated into a scaffolding assembly where the locking and securing device is in an unengaged and unlock position.

The first side rail 14 has a first end 40 which terminates at a guard rail socket 44. It is to be understood that the guard rail socket 44 can have any suitable cross-sectional shape, including but not limited to a generally round, square or rectangular shape and is shaped for receiving a guard rail (not shown). Attached to the guard rail socket 44 is a vertically extending channel member 60. The channel 60 is operatively connected to the guard rail socket 40 in a suitable manner. Alternatively, the channel 60 and guard socket can be made as a uniform piece. The channel 60 has a first side 62 and a second, opposing side 64 connected by a base or third side 66, as best seen in FIG. 2.

It is to be understood that, in the embodiment shown, the side rail 14 and the opposing side rail 34 each has ends which are similar to the first end 40, and that for ease of explanation, only one end 40 of the side rail 14 and the locking and securing device 10 operatively connected thereto, will be described in detail.

Figure 3:
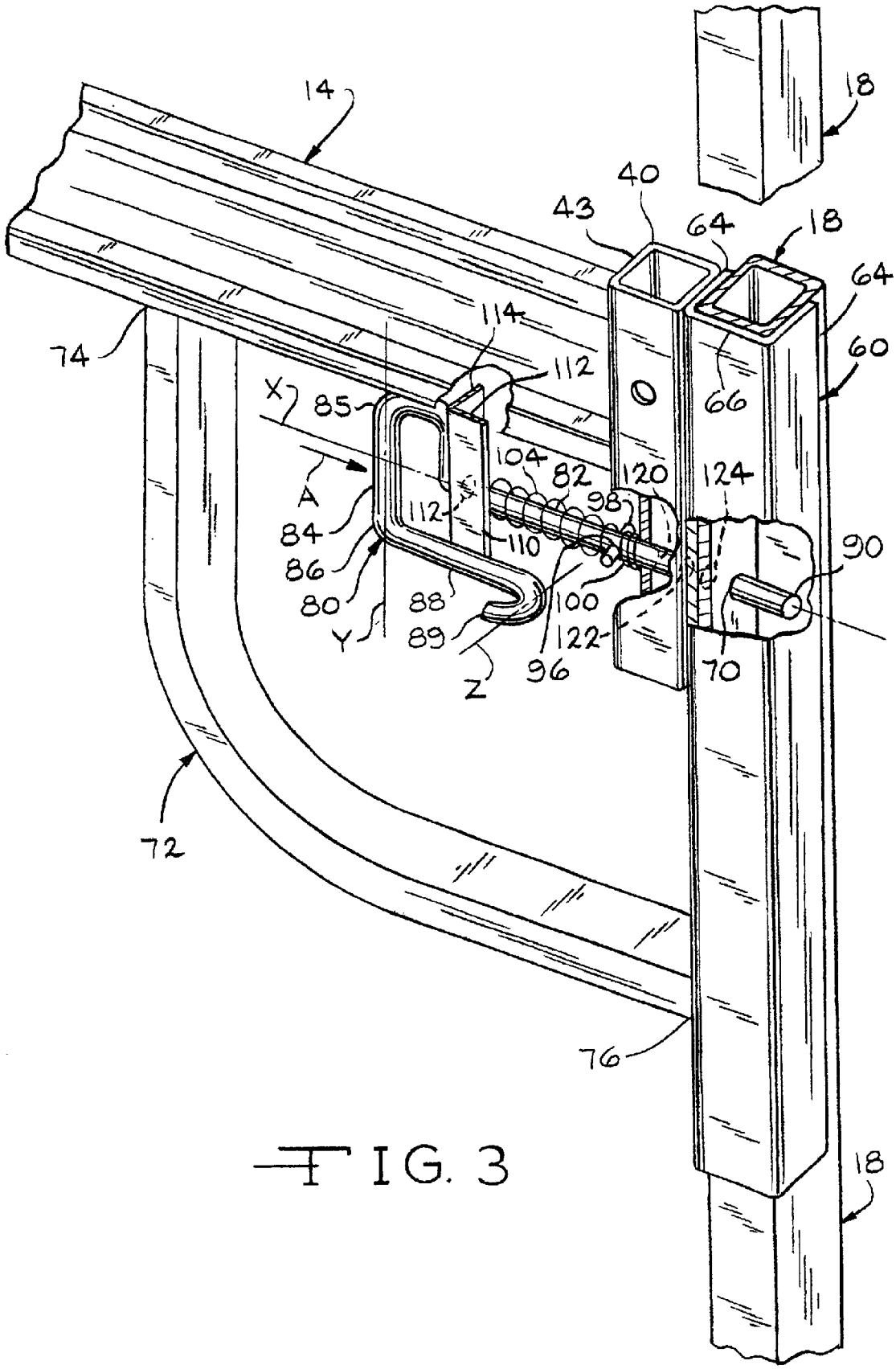
FIG. 3 is a perspective view, partially in phantom and partially in cross-section, of a locking and securing device incorporated into a scaffolding assembly where the locking and securing device is in an engaged, but unlocked, position.

It can be seen in FIGS. 1 and 3 that when the side rail 14 is positioned adjacent the leg 18 the three sides 62, 64 and 66 of the channel 60 are positioned around the vertical supporting leg 18. In the embodiment shown, the dimensions of the channel 60 and the vertical supporting leg 18 allow the channel 60 to be easily positioned around the leg 18 such that the channel 60 can be easily moved up and down the leg 18 in order to position the working platform 34 at a desired height.

As shown in FIG. 1, the vertical support members 18, 20, 28 and 30 define a plurality of vertically spaced apart apertures or openings 70 such that the side rail 14 can be positioned at different heights on the support members 18, 20, 28 and 30, as will be described in detail below. That is, the front support members 18 and 28 and the rear support members 20 and 30 have a plurality of spaced apart apertures 70 such that opposing apertures are positioned in the same horizontal plane. The side rails 14 and 34 are moved and engaged within the apertures 70 on the opposing front and rear supporting vertical members, respectively.

In the embodiment, shown the side rail 14 and the side rail 34 each has substantially the same structure such that a guard rail can be either used on a front or rear of the scaffold. In the embodiment shown, a gusset 72 is positioned in a spaced apart relationship to the end 40 of the side rail 14. The gusset 72 has a first end 74 which is attached to the side rail 14 and a second end 76 which is attached to the channel 60 at a predetermined distance away from the guard rail socket 44 and adjacent a lower end 65 of the channel 60.

Referring now to FIGS. 2–5, the locking and securing device 10 is described in detail in connection with a scaffold. It should be understood, however, that the locking and securing device is useful in other applications and that such other applications are within the contemplated scope of the present invention.

The locking and securing device 10 includes a securing means or mechanism 80. The securing mechanism 80 includes a longitudinally extending securing pin 82, which, in this embodiment, is integrally formed with a handle 84. The handle 84 has a length L. The pin 82 of the securing mechanism 80 extends in a direction away from the handle 84 in such a manner that the pin 82 is in a spaced apart relationship to the handle and is positioned substantially centered at the middle of the handle 84.

The handle 84 has a first end 85 which extends between the handle 84 and the pin 82. The first end 85 extends away from the handle 84 at an angle. In the embodiment shown, the first end 85 extends at an angle from the handle 84 and terminates at the pin 82. The first end 85 generally has a depending section 83 such that the first end 85 and the depending section 83 generally define an angle. The depending section 83 terminates at the pin 82. It should be understood that it is within the contemplated scope of the present invention that the handle 84, the first end 85, and the depending section 83 each has a shape and dimension that readily allow a worker to freely grasp the handle 84 and that such readily shape provides sufficient room and clearance for the worker's fingers and knuckles. As such, while the embodiment in the figure shows the depending section 83, first end 85, handle 84 and locking member 88 as defining a generally rectangular shape, other specific embodiments having shapes of the handle which allow for ease of grasping the handle 84 are also within the contemplated scope of the present invention. In the embodiment shown, the handle 84 has a length L while the depending section 83 of the first end 85 has a length ½L such that the pin 82 is positioned in a spaced apart relationship at substantially the center of the handle 84.

The securing mechanism 80 further includes a locking means or member 88, which in this embodiment, is integrally formed the handle 84. The locking member 88 extends from a second end 86 of the handle 84 in a direction away from the handle 84. The second or opposed end 86 is in a spaced apart relationship from the first end 85 of the handle 84. In the embodiment shown, the locking member 88 and the handle 84 are in the same plane and the locking member 88 extends from the handle 84 at an angle. One embodiment, as shown in the figures shows the locking member 88 extending from the handle 84 at approximately a right angle.

The locking member 88 has an extending section 81 and an engaging means or section 87. The extending section 81 is connected to the second end 86 of the handle 84 while the engaging section 87 is a spaced apart relationship to the second end 86 of the handle 84. The engaging section 87 extends at an angle from the locking member 88. In the embodiment shown, the engaging section 87 defines a distal end 89 which extends generally at an angle in a direction back toward the handle 84. In the embodiment shown, the distal end 89 has a generally hocked, or C-shape. It is within the contemplated scope of the present invention that other embodiments can have the engaging section 87 define a different shaped distal end 89, such as an acute angled shape or square or rectangular shape.

If the securing mechanism 80 were projected onto a three dimensional graph, the handle 84 would be in a plane extending through a line defined by the Y axis while the pin 82 would be in a plane extending through a line defined by the X axis. The pin 82 and the handle 84 are in the same plane (as defined by the X and Y axes). The pin 82 of the securing mechanism 80 is also in a spaced apart and parallel relationship with the extending section 81 of the locking member 88. That is, the extending section 81 is also in a plane defined by the X axis. The engaging section 87 of the locking member 88 in a plane extending through a line defined by the Z axis away from the X axis (i.e., the Z plane is perpendicular to the X and Y axes). The distal end 89 extends from the engaging section back in a direction toward the handle 84 such that the distal end 89 is in a second plane extending through a line defined by a second Y axis.

Figure 4:
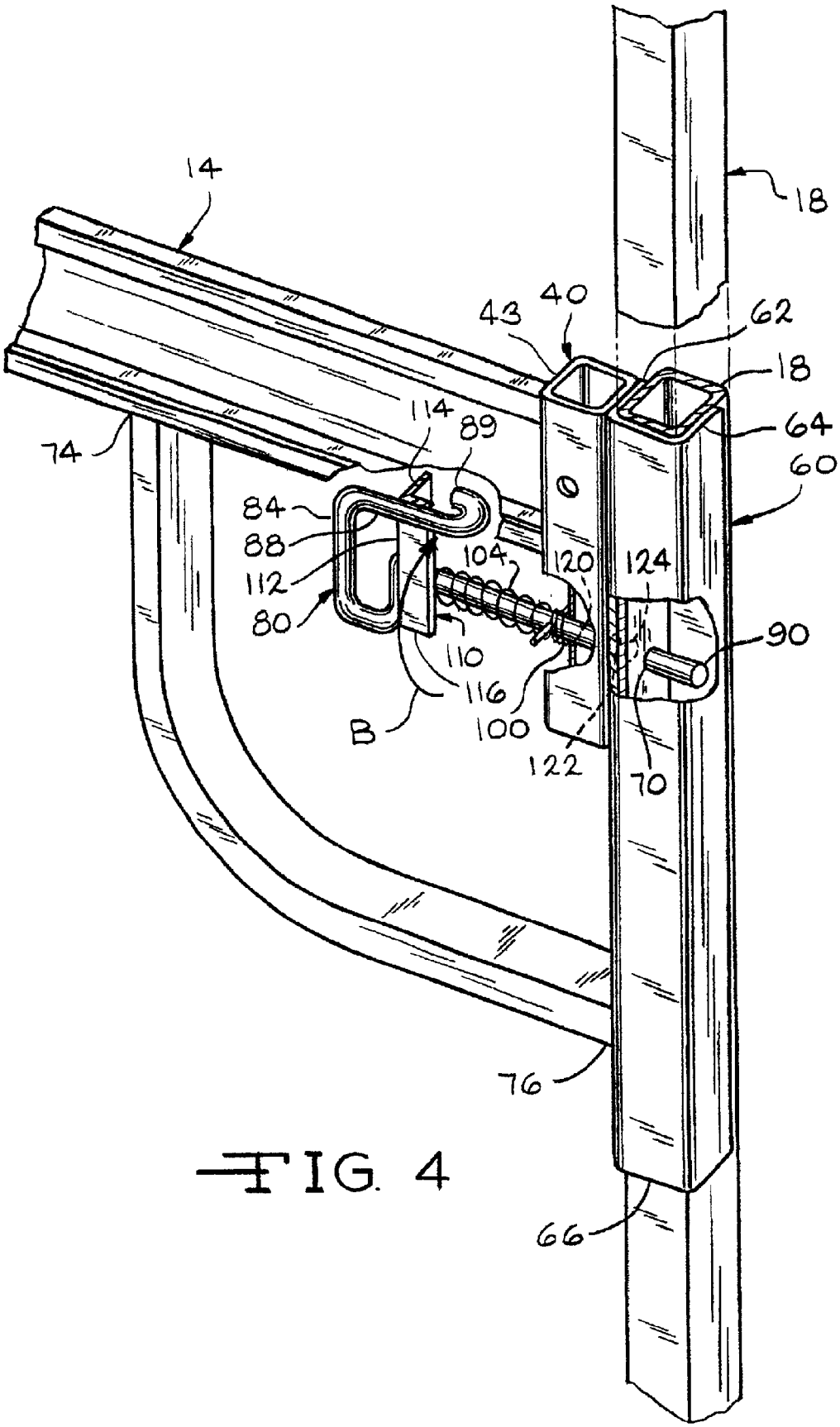
FIG. 4 is a perspective view, partially in phantom and partially in cross-section, of a locking and securing device incorporated into a scaffolding assembly where the locking and securing device is in an engaged and is being moved into a locking position.
Figure 5:
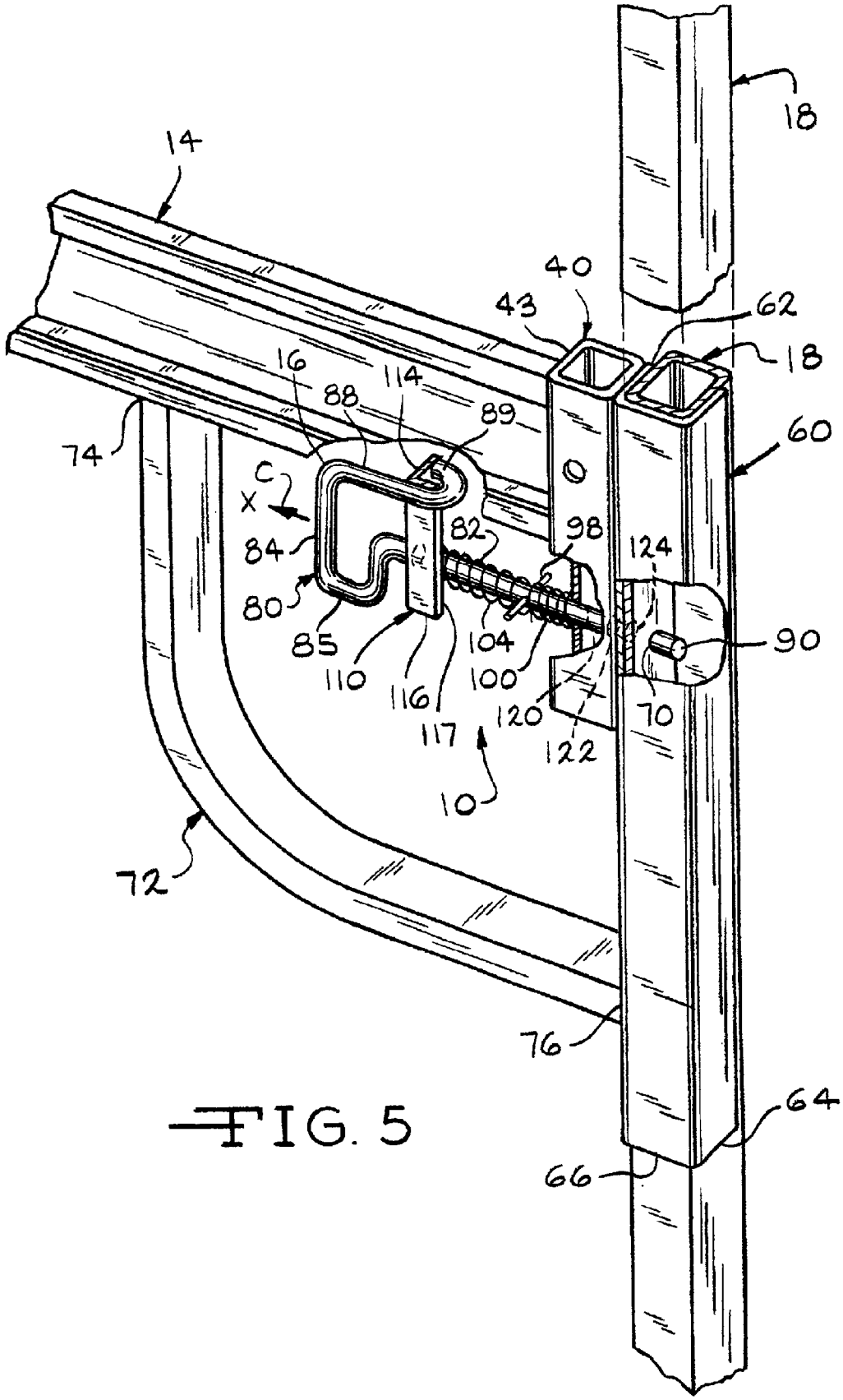
FIG. 5 is a perspective view, partially in phantom and partially in cross-section, of a locking and securing device incorporated into a scaffolding assembly where the locking and securing device is in an engaged and locked position.
Figure 6:
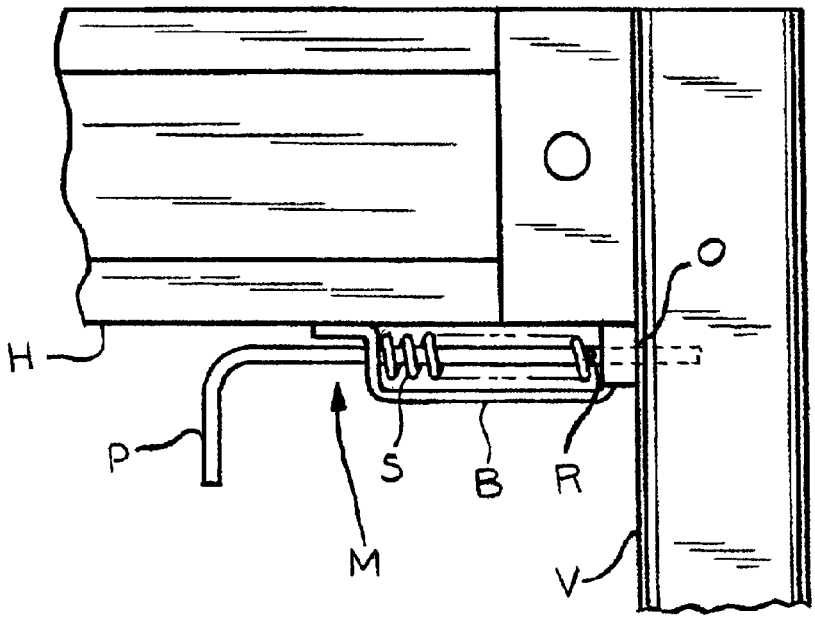
FIG. 6 PRIOR ART
FIG. 6 is a side elevational view, partially in phantom, of a prior art latch mechanism.
Figure 7:
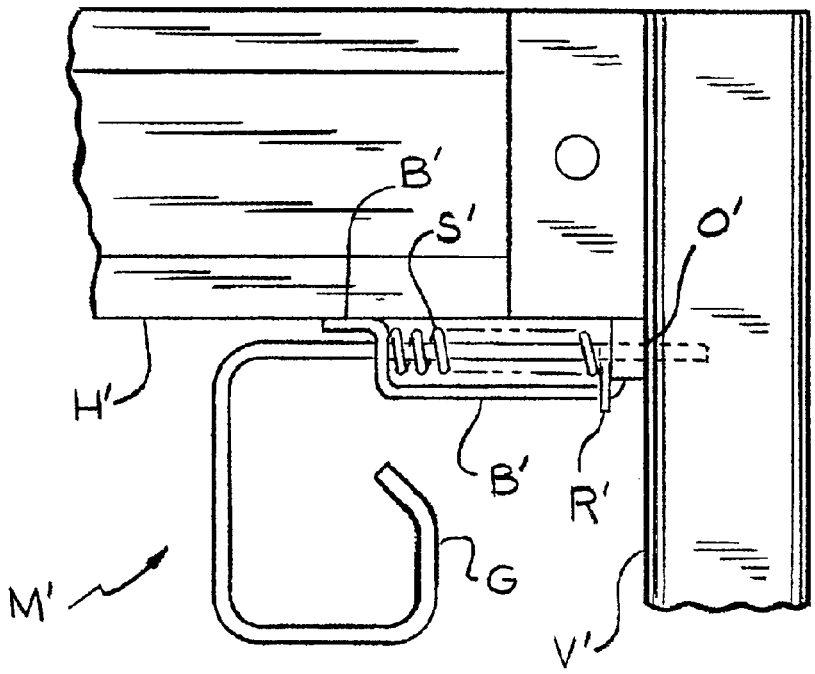
FIG. 7 PRIOR ART
FIG. 7 is a side elevational view, partially in phantom, of another prior art latch mechanism.

The pin 82 defines a longitudinally extending portion 94 having a first end 90 which is in opposed relationship to a second end 92. The second end 92 is adjacent the depending end 83 of the first end 85 of the handle 84. The pin 82 defines an opening 96 which receives a rivet or roll pin 98. In a the embodiment shown, the opening 96 is spaced at a midpoint located approximately midway between the first end 90 and the second end 92 of the pin 82. The opening 96 extends through the pin 82 in a substantially Z direction when the securing mechanism 80 is in an open and unsecured position, as shown in FIG. 2, and when the securing mechanism is in the locked, and locked and secured position, as shown in FIGS. 4 and 5, respectively.

The locking and securing device 10 further includes a first biasing member, such as, for example a spring, 100 which is axially positioned between the roll pin 98 and the first end 90 of the pin 82 along the axis defined by the pin 82. The locking and securing device 10 further includes a second biasing member or, such as, for example a spring, 104 which is axially positioned on the pin 82 in an opposed relationship to the first biasing member 100 and is positioned on an opposite side of the roll pin 98 and adjacent the second end 92 of the first pin 82.

In the embodiment shown, the locking and securing device 10 is shown being operatively connected to and positioned on the scaffold 12. In various embodiments, the locking and securing device 10 further includes a guide or engagement member 110, as described in detail below, which can be operatively connected to or integrally formed with the scaffold 12. In other, diverse applications where the locking and securing device 10 is to be used, similar type engagement members can be connected to or are formed with a part of that particular application. This can best be understood by referring to the figures herein which show such engagement member 110 on the scaffold 12.

FIG. 2 shows the locking and securing device 10 in an open and unsecured position. The securing mechanism 80 is held or suspended from the side rail 14 by the engagement member 110. In the embodiment shown, the engagement member 110 has a substantially L-shape; however, other shapes are also within the contemplated scope of the invention. The pin 82 of the securing mechanism 80 extends through an opening 112 in a first arm 114 of the engagement member 110. The engagement member 110 has a second arm 116 which extends at an angle from the first arm 114 in a direction toward the first end 90 of the pin 82. The pin 82 axially extends through the opening 112 of the first arm 114 at substantially a right angle. In the open and unlocked position shown in FIG. 2, the second biasing member 104 is under compression.

Referring now to FIG. 3, the locking and securing device 10 is shown in a secured position where the side rail 14 is positioned against the vertical support 18. The guard rail socket 40 defines opposing openings 120 and 122 which are in an axial relationship for receiving the pin 82. A further axially positioned opening 124 extends through the side leg 64 of the channel 60 for receiving the first end 90 of the pin 82. The pin 82 is at a right angle with respect to the guard rail support 44 and the channel 60. As shown in FIG. 3, the securing mechanism 80 is moved in a direction of the arrow A by applying a force, or pushing, on the handle 84. The securing mechanism 80 is moved in an axial direction along the X axis such that the second biasing member 104 is no longer under compression, but the first biasing member 100 is now under compression. The first end 90 of the pin 82 passes through the openings 120 and 122 of the guard rail socket 40 and through the opening 124 in th side leg 64 of the channel 60. The first biasing member 100 is compressed between a first side 43 of the guard rail socket 40 and the pin 98.

The handle 84 is in an opposed and centered position with respect to the pin 82. That is, the handle 84 is positioned in a spaced apart relationship substantially at the center of the pin 82. The centered position of the handle 84 with respect to the pin 82 reduces the pressure on the worker's fingers or hand by reducing or eliminating the torque force. The resulting friction needed to compress the first biasing member 100 and to advance the securing mechanism 80 in a direction toward the vertical support member 18 is greatly reduced.

FIG. 4 shows the securing mechanism 80 in a rotated position about the X axis. The securing mechanism 80 is rotated in the direction of arrow B by grasping the handle 84. In operation, the securing mechanism 80 is rotated about the X axis of the pin 82 such that the locking member 88 is rotated at least about 160° to about 180° about the X axis. The locking member 88 is brought into an adjacent relationship with the engagement member 110. It is to be understood that the locking member 88 has a sufficient length to allow the locking member 88 to freely rotate in an upward direction (while the first biasing member 100 is in a compressed state) such that the distal end 89 of the locking member 88 extends beyond the second arm 116 of the engagement member 110. The locking member 88 is brought into engaging contact with the engagement member 110 when the force on the securing mechanism 80 is released, as shown in FIG. 5.

FIG. 5 shows the locking and securing device 10 in a locked and secured position. The securing mechanism 80 is allowed to move in the axial direction of arrow C along the X axis. By releasing the compressive tensioning force on the handle 84, the first biasing member 100 acts to move the securing mechanism 80 in a direction toward the engagement member 110. The hook or distal end 89 engages the second arm 116 of the engagement member 110. The second biasing member 104 provides tension on the securing mechanism 80 to keep the distal end 89 of the locking member 88 secured against the second arm 116 of the engagement member 110.

As can best be seen in FIGS. 4 and 5, the rivet or roll pin 98 is in a spaced apart relationship from the first end 90 of the pin 82. In the embodiment shown, the pin 98 is a predetermined mid point distance away from the load being placed on the pin 82 by the weight of the side rail 14, vertical support 18, and work platform 36. The distance between the roll pin 98 and the load (which is supplied by the platform at the point of contact of the aperture 70 in the vertical support member 18) results in decreased load stresses on the pin 82. That is, there is less bending moment when the pin 98 is in a spaced apart relationship from the load and, consequently, there is less likely to be failure of the pin 82 or securing mechanism 80.

In the embodiment shown, the securing mechanism 80 is made as a single piece. The securing mechanism 80 is fully compatible with many types of scaffolding assemblies currently in use. Further, the securing mechanism 80 provides additional safety by having the hook or distal end 89 engage the engagement member 110 to ensure that the locking and securing device 10 is not accidentally unsecured.

In operation, the locking and securing device 10 is opened by first moving the handle 84 in a direction toward the engagement member 110 thereby compressing the second biasing member 104. The handle 84 is rotated about the X axis in a direction away from the engagement member 110 such that the distal or hook end 89 of the locking member 88 is rotated in a direction away from the engagement member 110, allowing the hook end 89 to clear or pass beyond the second arm 116 of the engagement member 110. Referring now again to FIG. 2, the handle 84 is moved away from the engagement member 110 in a direction shown by arrow D. As the handle 84 is moved toward the gusset 72, the second biasing member 104 is compressed between the pin 98 and the first arm 112 of the engagement member 110. The movement of the handle 84 in the direction of arrow D allows the first end 90 of the pin 82 to be removed from the vertical support member 18 such that the side rail 14 is unsecured from the vertical support member 18. The pin 82 travels in a direction away from the channel 60 such that the first end 90 of the securing mechanism 80 is withdrawn from the opening 122 in the leg 62 and from the opening 70 in the vertical support member 18.

It is to be understood that the biasing members 100 and 104 can be any type of suitable biasing or spring mechanism including, for example, a wave washer under tension or one spring having opposing ends positioned on either side of the roll pin 18. The biasing member acts to allow compression and tension to be put on the securing mechanism 80 while the securing mechanism 80 is being moved to a closed position and when the securing mechanism in the closed and locked position.

The locking and securing device 10 provides the worker with an easy to operate locking and securing mechanism. In embodiments where the locking and securing device 10 is used to secure a scaffold, the gusset 72 is positioned at a determined distance away from the device 10 such that the worker can wrap his hand around the gusset 72 (for example, having the thumb on one side of the gusset and the palm and fingers on an opposing side of the gusset). The position of the gusset 72 allows the worker's fingers to be easily secured or wrapped around the handle 84 of the securing mechanism 80. The gusset 72 provides leverage and ease of motion for initially securing the side rail channel 14 onto the vertical support. It is to be understood that, while the lengths of the side rail 14 can be of any desired distance or length, the length of the side rail 14, in many commercial embodiments, is such that the worker can simultaneously operate opposing securing mechanisms 80 on each end of the side rail. Once the side rail 14 is initially secured in the corresponding apertures 70 in each vertical support member 18, the worker then individually locks the securing mechanism 80 by pivoting the pin 82 about the X axis allowing the distal end 89 of the locking member 88 to be secured adjacent the engagement member 110.

While the securing mechanism 80 is shown as having a generally rectangular shaped handle 84 and a C-shaped distal end 89 which extends therefrom at a right angle, it is to be understood that other shapes can be used, such, as square, rectangular or circular, to form the handle 84 and locking member 88 and that such are within the contemplated scope of the present invention.

The locking and securing device of the present invention provides a pin and locking assembly in a single unit which simplifies construction and reduce the costs of the locking and securing device. The locking and securing device is incorporated into a scaffold, requires fewer welding points in order to produce than in many currently used latch mechanism.

It is to be understood that it is within the contemplated scope of the present invention that the locking and securing device can be used for purposes other than securing side rails to vertical supports of a scaffold. The positive securing and locking components of the locking and securing device can be used in other applications where it is desired to both secure and lock a first member in an opposed relationship to a second member.

Although the invention has been described in detail with reference to a certain preferred embodiment, variations and modifications exist within the scope and spirit of the invention as described and defined in the following claims.

I claim:

1. A scaffold system comprising at least one first support and at least one second support and at least one locking and securing device for removably securing and locking the first support to the second support, the locking and securing device having a means for securing the first support to the second support, the securing means being movably attached to the first support and being movable between a secured position and an unsecured position with respect to the second support by using a force at a substantially coaxial center point of the securing means; and a means for locking the securing means to the first support when the securing means is in the secured position in the second support, the locking means being integrally formed with a handle;

the securing means and the locking means being rotatably moveable about a longitudinal axis extending through the securing means, the locking means being longitudinally moveable along the longitudinal axis thereby allowing the securing means to be moveable between the secured position and the unsecured position and thereby allowing the locking means to be moveable between a locked position and an unlocked position;

wherein the second support includes at least one opening for receiving the securing means when the securing means is in the secured position;

wherein the first support includes a channel member for receiving a portion of the second support when the first support is secured to the second support;

wherein the channel member defines at least one opening for receiving a portion of the securing means;

further including at least one guide rail socket for receiving one end of a guide rail, the guide rail socket being adjacent and substantially parallel to the channel member; and wherein the guide rail socket defines first and second openings that are in opposing sides of the guide rail socket for receiving a portion of the securing means.

2. The scaffold system of claim 1, wherein the securing means includes a securing pin and a handle positioned in a spaced apart relationship to and at substantially the center point of the securing pin.

3. The scaffold system of claim 2, wherein the securing pin is positioned at an angle with respect to the first support.

4. The scaffold system of claim 2, wherein the handle is integrally formed with the locking means.

5. The scaffold system of claim 2, wherein the locking means includes an engaging means for engagement with the first support when the locking means is in the locked position.

6. The scaffold system of claim 5, wherein the first support is operatively connected to an engagement means for engagement with the engaging means of the locking means.

7. The scaffold system of claim 6, wherein the securing means is positioned at an angle with respect to the engagement means and extends through an opening in the engagement means.

8. The scaffold system of claim 1, wherein the securing means further includes at least one biasing means for holding the securing means in the secured position.

9. The scaffold system of claim 8, wherein the securing means further includes a second biasing means for holding the locking means in the locked position.

10. The scaffold system of claim 9, wherein the first biasing means and the second biasing means are coaxially positioned on the securing means.

11. The scaffold system of claim 10, wherein the first and second biasing means are spaced apart from one another by a rivet pin extending radially through the securing means.

12. The scaffold system of claim 3, wherein the rivet pin is positioned in the securing pin at substantially a midpoint along a longitudinal length of the securing means.

13. The scaffold system of claim 2, wherein the handle and the securing pin are at an angle with respect to each other and are in the same plane with respect to each other.

14. The scaffold system of claim 13, wherein the locking means includes an engaging means which is in a spaced apart relationship to the handle and is positioned at an angle to the handle, the engaging means and the handle each defining planes that are perpendicular to each other.

15. The scaffold system of claim 14, wherein the second support defines an engagement member for engagement with the locking means when the locking means is in the locked position.

16. The scaffold system of claim 15, wherein the engagement member is operatively connected to the first support.

17. The scaffold system of claim 1, wherein the securing means has no threaded portion.

18. The scaffold system of claim 1, wherein the locking means has no threaded portion.

19. The scaffold system of claim 1, wherein the securing and the locking means are secured by being rotated about one half turn.

20. The scaffold system of claim 1, wherein the securing means and the locking means are secured by being rotated about 160° to about 180°.

* * * * *